United States Patent [19]

Watanabe

[11] 4,342,304

[45] Aug. 3, 1982

[54] CONTACTLESS IGNITON CIRCUIT FOR INTERNAL COMBUSTION ENGINES

[75] Inventor: Hiromi Watanabe, Yokosuka, Japan

[73] Assignee: Oppama Kogyo Kabushiki Kaisha, Kanagawa, Japan

[21] Appl. No.: 164,508

[22] Filed: Jul. 2, 1980

[30] Foreign Application Priority Data

Dec. 1, 1979 [JP] Japan ..... 54-156119

[51] Int. Cl.[3] ..... F02P 3/08

[52] U.S. Cl. ..... 123/599; 123/149 R; 123/651

[58] Field of Search ..... 123/149 R, 149 C, 149 D, 123/599, 651, 652, 650

[56] References Cited

U.S. PATENT DOCUMENTS 4,149,509 4/1979 Mathieu ..... 123/599

4,163,437 8/1979 Notaras et al. ..... 123/651

OTHER PUBLICATIONS

Heathkit "Individual Learning Program in Semiconductor Devices", Copyright 1975, pp. 8-44—8-47.

*Primary Examiner*—Tony M. Argenbright

[57] ABSTRACT

The present invention relates to a contactless ignition circuit for internal combustion engines wherein a primary short-circuiting current flowing through the primary winding of an ignition coil is made to flow through a power transistor controlled to be conducted and interrupted by a programable unijunction transistor and a potential dividing type capacitor is connected to the anode electrode so as to operate this programable unijunction transistor when the wave height value of the primary short-circuiting current flowing through the above mentioned primary winding becomes maximum so that a spark plug connected to the secondary winding will be operated to ignite at a high sensitivity.

1 Claim, 2 Drawing Figures

CONTACTLESS IGNITON CIRCUIT FOR INTERNAL COMBUSTION ENGINES

Figure 1:
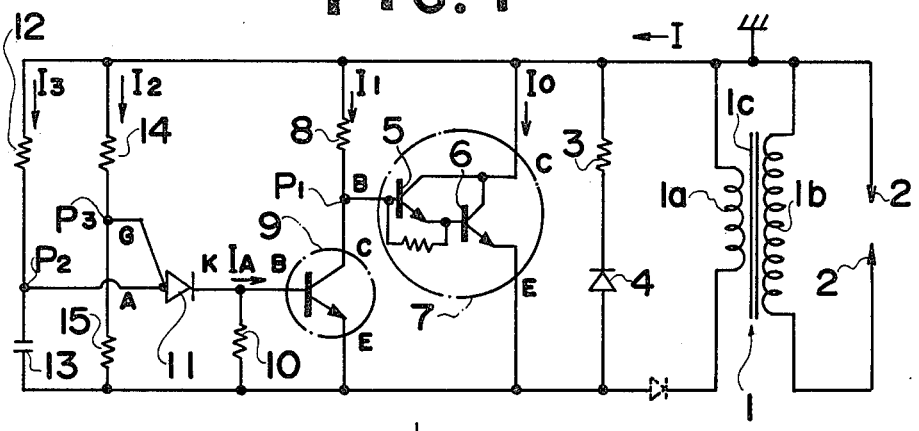

This invention relates to a contactless ignition circuit for internal combustion engines particularly wherein a primary short-circuiting current flowing through the primary winding of an ignition coil is made to flow through a power transistor controlled to be conducted and interrupted by a programable unijunction transistor and a potential dividing type capacitor is connected to the anode electrode so as to operate this programable unijunction transistor when the wave height value of the primary short-circuiting current flowing through the above mentioned primary winding becomes maximum so that a spark plug connected to the secondary winding will be operated to ignite at a high sensitivity.

Further, in the present invention, as no current source coil is used as before, there is no fear of causing an accident of melting off by a surge voltage and the circuit formation and setting structure can be simplified.

There is already known an ignition circuit for internal combustion engines wherein a primary short-circuiting current of the primary winding for ignition is interrupted and conducted by a mechanical contact connected in parallel with a capacitor for extinguishing arcs with the rotation of the crankshaft of the engine. However, in such ignition circuit, there have been problems that it is difficult to set the positions by which a mechanical contact and an interruption and conduction contrlling cam are fit and the wear of the contact is so remarkable that the durability of the contact is low. Further, there is naturally a limit in the structure to the reduction of the entire shape and many complicated steps are required to assemble it.

On the other hand, there are provided ingition circuits wherein a voltage induced by a current source winding is accumulated in a capacitor and this accumulated electric charge is discharged to the primary winding of an ignition coil by a silicon controlled element and wherein a primary short-circuiting current induced in the primary winding of an ignition coil by the rotation of the flywheel magnet is made to flow through a power transistor, this power transistor is conducted and interrupted by the trigger of a silicon controlled element and the trigger of this element is controlled by a resistance branch circuit of an induction current flowing through the primary coil.

However, in the former ignition circuit, the places of setting the silicon controlled element and trigger coil can be made small without limit, the contact is not worn and the life on the circuit is long but there are defects in that the weight is increased and the current source winding is melted and cut by a surge voltage. The latter ignition circuit is of a subswitch system using a thyristor and small signal transistor, the trigger level of the thyristor is so high that the response sensitivity is low and therefore there is an inconvenience that no ignition can be made at the time of a low speed.

The present invention is to solve such various problems in the conventional ignition circuit and particularly has it as an object to provide a novel contactless ignition circuit for internal combustion engines wherein a primary short-circuiting current flowing through the primary winding of an ignition coil is controlled to be conducted and interrupted through a power transistor, this controlling operation is made by a programable unijunction transistor and small signal transistor, the trigger of the programable unijunction transistor is adjusted by a potential dividing circuit of a resistance and capacitor and the programable unijunction transistor is controlled to be on and off at a high sensitivity with the adjusted trigger level so that an efficient ignition can be made even at the time of a low speed rotation of the flywheel magnet.

Figure 2:
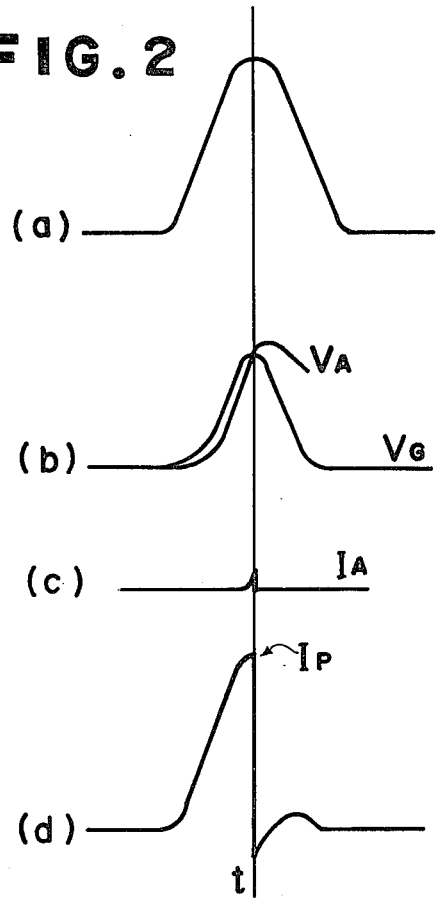

The above mentioned object, other objects, features and advantages of the present invention will become clear from the following detailed descriptions of embodiments shown in the accompanying drawings in which:

FIG. 1 is a contactless ignition circuit diagram in accordance with the present invention;

FIGS. 2(*a*) to (*c*) are wave form views of the respective parts of the above mentioned circuit;

FIG. 2(*a*) is a wave form view of a current flowing through the primary winding in case the power transistor is not interrupted;

FIG. 2(*b*) shows a wave form view of the anode voltage of the programable unijuntion transistor and a wave form view of the gate voltage;

FIG. 2(*c*) is a wave form view of a current $I_A$ flowing through the programable unijunction transistor;

FIG. 2(*d*) is a wave form view of a current flowing through the primary coil when the power transistor is cut off.

In FIG. 1, reference numeral 1 denotes an ignition coil having a primary winding 1*a* and secondary winding 1*b* connected as illustrated through an iron core 1*c*. That is to say, both windings 1*a* and 1*b* are made by doubly winding a small amount of a thick lead wire and a large amount of a thin lead wire on the same iron core 1*a* and one terminal of each of them is connected to a common ground. Further, a spark plug 2 is connected between both terminals of the secondary winding 1*b*. The circuit relating to this secondary winding 1*b* is the same as that of the conventional one. To both ends of the above mentioned primary winding 1*a*, a series circuit consisting of a resistance 3 and rectifying diode 4 is connected in parallel and the collector and emitter of a transistor 6 of two Darlington-connected transistors 5 and 6 forming a power transistor 7 are connected respectively as illustrated. Further, to both ends of the above mentioned primary winding 1*a*, a voltage controlling resistance 8 and the collector and emitter of a small signal transistor 9 are connected as illustrated. To a connecting neutral point $P_1$ of the resistance 8 and the collector of the transistor 9, the base of the above mentioned transistor 5 is connected. Reference numeral 10 denotes a current adjusting resistance. The base of the transistor 9 and the grounding terminal of the primary winding 1*a* are connected with the terminal on the other side. Reference numeral 11 denotes a programable unijunction transistor in which the cathode is connected to the base of the above mentioned transistor 9. Its anode is connected to a connecting neutral point of a series circuit consisting of a resistance 12 and capacitor 13 connected in parallel with the above mentioned primary winding 1*a*. The resistance 12 and capacitor 13 form a potential dividing circuit and the capacitor 13 operates to charge and discharge electricity. Further, the gate of the above mentioned programable unijunction transistor 11 is connected to a connecting neutral point P3 of a potential dividing circuit consisting of resistances 14 and 15 connected in parallel with the above mentioned primary winding. By the way, it is necessary to set the capacitance of the above mentioned capacitor 13 in advance to be of such size as to operate the programable unijunction transistor due to the correlation with the potential of the above mentioned gate when the wave height value of the primary short-circuiting current flowing through the primary winding 1*a* becomes maximum.

The operation of the contactless ignition circuit of the above mentioned formation shall be explained in the following.

First, by the rotation of the flywheel magnet, a primary short-circuiting current I will be induced in the primary winding 1*a* of the ignition coil 1 and will be divided as in $I_0$, $I_1$, $I_2$ and $I_3$ into the above mentioned four circuits connected in parallel with the primary winding 1*a*. By the way, the wave form of the current produced in the primary winding 1*a* at this time is shown in FIG. 2(*a*). At this time, the power transistor 7 will not be interrupted. That is to say, a predetermined voltage will be obtained at the points $P_2$ and $P_3$ by the above mentioned divided currents $I_2$ and $I_3$ but, at the beginning of charging the above mentioned capacitor 13, the voltage at both ends of the capacitor 13 will not be high enough, therefore the potential at the point $P_2$ will be lower than the potential at the point $P_3$ and the above mentioned programable unijunction transistor 12 and small signal transistor 19 will not operate. Therefore, when the potential at the point $P_1$, that is, at the base rises, the collector and emitter of the transistor 6 will conduct, the above mentioned primary winding 1*a* will be short-circuited and such primary shortcircuiting current as is shown in FIG. 2(*a*) will be fed to it. On the other hand, the charged voltage of the capacitor 13 charged with the above mentioned divided current $I_3$ will rise and, at a fixed voltage value determined by the time constant of its capacitance and the above mentioned resistnce value 12, the anode voltage of the programable unijunction transistor will become higher than the gate voltage in respect of the time. The relation between such anode voltage and cathode voltage is shown in FIG. 2(*b*). At the above mentioned fixed voltage value at which both voltage values are equal, the programable unijunction transistor 11 will conduct, such current $I_A$ as is shown in FIG. 2(*c*) will flow into its cathode side and the small signal transistor 9 will be driven by this current $I_A$. When the collector and emitter of the small signal transistor 9 conduct, the base potential of the transistor 5 forming the above mentioned power transistor 7 will fall, this transistor 5 will be off and the current flowing to such $I_p$ as is shown in FIG. 2(*d*) will be interrupted. Thus, by such interrupting operation of the power transistor 7, a high voltage will be induced on the secondary winding side. What is important here is to set in advance the values of the above mentioned capacitor 13 and resistance 12 so that, when the primary short-circuiting current becomes substantially to be of the maximum value (time point t), the above mentioned programable unijunction transistor 11 will be triggered. At the time point t at which the potential (anode potential) at both ends of the capacitor 13 exceeds the gate potential, this programable unijunction transistor 7 will be off and the interrupting operation will be effectively made. Here, the sensitivity of the gate trigger of the programable unijunction transistor 11 is so sufficiently higher than of the one adopting the subswitching system of the conventional thyristor or transistor that, even with a minute current, the trigger is easy. Therefore, even if the rotation of the flywheel magnet is low, if an expected relative potential difference is formed between the above mentioned points $P_2$ and $P_3$, the operation of the programable unijunction transistor will be able to be made possible. Thus, its on-off signal transistor 9 will sharply rise and the power transistor 7 will be efficiently and quickly controlled. Thus, in this contactless ignition circuit, the same as in the conventional point type igniting means, an ignition in a low speed range can be smoothly made and the internal combustion engine can be quickly and efficiently started.

As explained in detail in the above, according to the present invention, a primary short-circuiting current flowing through the primary winding of an ignition coil is conducted and interrupted by a power transistor controlled by a programable unijunction transistor and small signal transistor and the trigger of the above mentioned programable unijunction transistor is controlled by the time constant of a potential dividing circuit consisting of a resistance and capacitor so that, even if the flywheel magnet rotates at a low speed and the current induced in the above mentioned winding is minute, the programable unijunction transistor will be operated at a high sensitivity, the power transistor will be able to be interrupted quickly and reasonably by a signal sharp in the rising operation, a high voltage will be generated in the secondary winding and an efficient ignition will be able to be made. Further, as no such current source coil as in the conventional type is used, there is no fear of causing an accident of melting off by a surge voltage and the circuit formation and setting structure can be simplified.

What I claim is:

1. A contactless ignition circuit for an internal combustion engine having a coil assembly including a primary winding, said cirucit comprising a power transistor, a small signal transistor, a programmable unijunction transistor, a first potential dividing circuit and a second dividing circuit, said power transistor having a collector and emitter connected respectively to the ends of the primary winding, said small signal transistor having a collector connected to the base of said power transmitter and via a resistance to one end of said primary winding, and an emitter connected to the other end of said primary winding, said programmable unijunction transistor having a cathode connected to the base of the signal transistor and an anode and gate connected respectively to said first and second potential dividing circuit, said first and second potential driving circuit being connected in parallel with said primary winding, said first potential dividing circuit consisting of a resistance and capacitor, said second dividing circuit consisting of two resistances.

* * * * *